US011844476B2

(12) United States Patent
Royale

(10) Patent No.: US 11,844,476 B2
(45) Date of Patent: Dec. 19, 2023

(54) EXTRACTION CLEANER

(71) Applicant: BISSELL Inc., Grand Rapids, MI (US)

(72) Inventor: Victoria J. Royale, Charlotte, MI (US)

(73) Assignee: BISSELL Inc., Grand Rapids, MI (US)

( * ) Notice: Subject to any disclaimer, the term of this patent is extended or adjusted under 35 U.S.C. 154(b) by 0 days.

(21) Appl. No.: 17/836,025

(22) Filed: Jun. 9, 2022

(65) Prior Publication Data

US 2022/0296072 A1 Sep. 22, 2022

Related U.S. Application Data

(63) Continuation of application No. 17/582,334, filed on Jan. 24, 2022, now Pat. No. 11,382,481, which is a continuation of application No. 16/286,030, filed on Feb. 26, 2019, now Pat. No. 11,259,679.

(60) Provisional application No. 62/638,477, filed on Mar. 5, 2018.

(51) Int. Cl.

| | |
|---|---|
| ***A47L 11/40*** | (2006.01) |
| ***A47L 7/00*** | (2006.01) |
| ***A47L 9/00*** | (2006.01) |
| ***A47L 11/30*** | (2006.01) |

(52) U.S. Cl.

CPC ..... *A47L 11/4083* (2013.01); *A47L 7/0009* (2013.01); *A47L 9/0027* (2013.01); *A47L 11/30* (2013.01); *A47L 11/4016* (2013.01); *A47L 11/4044* (2013.01); *A47L 11/4075* (2013.01); *A47L 11/4088* (2013.01)

(58) Field of Classification Search

CPC .. A47L 11/4083; A47L 7/0009; A47L 9/0027; A47L 11/30; A47L 11/4016; A47L 11/4044; A47L 11/4075; A47L 11/4088; A47L 7/02; A47L 5/24; A47L 11/4094

See application file for complete search history.

(56) References Cited

U.S. PATENT DOCUMENTS

| | | | |
|---|---|---|---|
| 5,237,720 | A | 8/1993 | Blase et al. |
| 5,301,386 | A | 4/1994 | Thomas et al. |
| 5,676,405 | A | 10/1997 | Reed |
| 5,784,755 | A | 7/1998 | Karr et al. |
| 6,125,498 | A | 10/2000 | Roberts et al. |
| 6,550,098 | B2 | 4/2003 | Roberts et al. |
| 7,073,226 | B1 | 7/2006 | Lenkiewicz et al. |
| 7,228,589 | B2 | 6/2007 | Miner et al. |
| 7,234,197 | B2 | 6/2007 | Tran |
| 7,685,671 | B2 | 3/2010 | Jansen |
| 8,370,991 | B2 | 2/2013 | Paliobeis et al. |
| 9,474,424 | B2 | 10/2016 | Moyher, Jr. et al. |
| 9,706,893 | B2 | 7/2017 | Wall et al. |
| 2007/0062000 | A1 | 3/2007 | Murphy et al. |
| 2014/0245560 | A1 | 9/2014 | Huang et al. |

(Continued)

FOREIGN PATENT DOCUMENTS

| | | | |
|---|---|---|---|
| AU | 2016101847 | A4 | 11/2016 |
| EP | 1018314 | A1 | 7/2000 |
| WO | 2013033514 | A1 | 3/2013 |

*Primary Examiner* — David Redding

(74) *Attorney, Agent, or Firm* — Warner Norcross + Judd LLP

(57) ABSTRACT

A surface cleaning apparatus includes a housing having a base and a partition, a supply tank removably mounted on the housing, and a recovery tank removably mounted on the housing. The tanks can be mounted within voids defined by portions of the housing. Latches can secure the tanks to the housing.

19 Claims, 11 Drawing Sheets

(56) References Cited

U.S. PATENT DOCUMENTS

| | | | |
|---|---|---|---|
| 2017/0127900 | A1 | 5/2017 | Wright et al. |
| 2017/0164801 | A1 | 6/2017 | Moyher et al. |

EXTRACTION CLEANER

CROSS-REFERENCE TO RELATED APPLICATIONS

This application is a continuation of U.S. patent application Ser. No. 17/582,334, filed Jan. 24, 2022, which is a continuation of U.S. patent application Ser. No. 16/286,030, filed Feb. 26, 2019, which claims the benefit of U.S. Provisional Patent Application No. 62/638,477, filed Mar. 5, 2018, all of which are incorporated herein by reference in their entirety.

BACKGROUND

Extractor cleaners are well-known surface cleaning devices for deep cleaning carpets and other fabric surfaces, such as upholstery. Most carpet extractors comprise a fluid delivery system and a fluid recovery system. The fluid delivery system typically includes one or more fluid supply tanks for storing a supply of cleaning fluid, a fluid distributor for applying the cleaning fluid to the surface to be cleaned, and a fluid supply conduit for delivering the cleaning fluid from the fluid supply tank to the fluid distributor. The fluid recovery system usually comprises a recovery tank, a nozzle adjacent the surface to be cleaned and in fluid communication with the recovery tank through a conduit, and a source of suction in fluid communication with the conduit to draw the cleaning fluid from the surface to be cleaned and through the nozzle and the conduit to the recovery tank. Portable extraction cleaners can be adapted to be hand-carried by a user, and in some cases include a hose coupled with a tool carrying the fluid distributor and the nozzle.

BRIEF SUMMARY

In one aspect, the disclosure relates to a surface cleaning apparatus having a housing comprising a base, a partition extending upwardly from the base, and a carry handle, a fluid delivery system comprising a supply tank and a fluid distributor, a fluid recovery system comprising a recovery tank, an extraction nozzle, and a motor/fan assembly, a first void within the housing, the first void defined by the base, the partition, and the carry handle, wherein the supply tank is removably received in the first void, and a second void within the housing, the second void defined by the base, the partition, and the carry handle, wherein the recovery tank is removably received in the second void.

In another aspect, the disclosure relates to a surface cleaning apparatus having a housing comprising a base and a partition extending upwardly from the base and defining a partition plane, a supply tank removably mounted on the housing on a first side of the partition plane, a recovery tank removably mounted on the housing on a second side of the partition plane, a supply tank latch to secure the supply tank to the housing, the supply tank latch moveable along a first latch axis that intersects the partition plane, and a recovery tank latch to secure the recovery tank to the housing, the recovery tank latch moveable along a second latch axis that intersects the partition plane and the first latch axis.

In yet another aspect, the disclosure relates to a surface cleaning apparatus having a housing comprising a base, a partition extending upwardly from the base, and a carry handle, a supply tank, a supply tank receiver comprising a first void within the housing to receive the supply tank, the first void defined by the base, the partition, and the carry handle, a recovery tank, and a recovery tank receiver comprising a second void within the housing to receive the recovery tank, the second void defined by the base, the partition, and the carry handle.

DETAILED DESCRIPTION

The disclosure relates to a surface cleaning apparatus that delivers cleaning fluid to a surface to be cleaned, such as extraction cleaner that also extracts cleaning fluid and debris from the surface. Aspects of the disclosure described herein are further related to a portable extraction cleaner that is adapted to be hand carried by a user to carpeted areas for cleaning relatively small areas.

Figure 1:
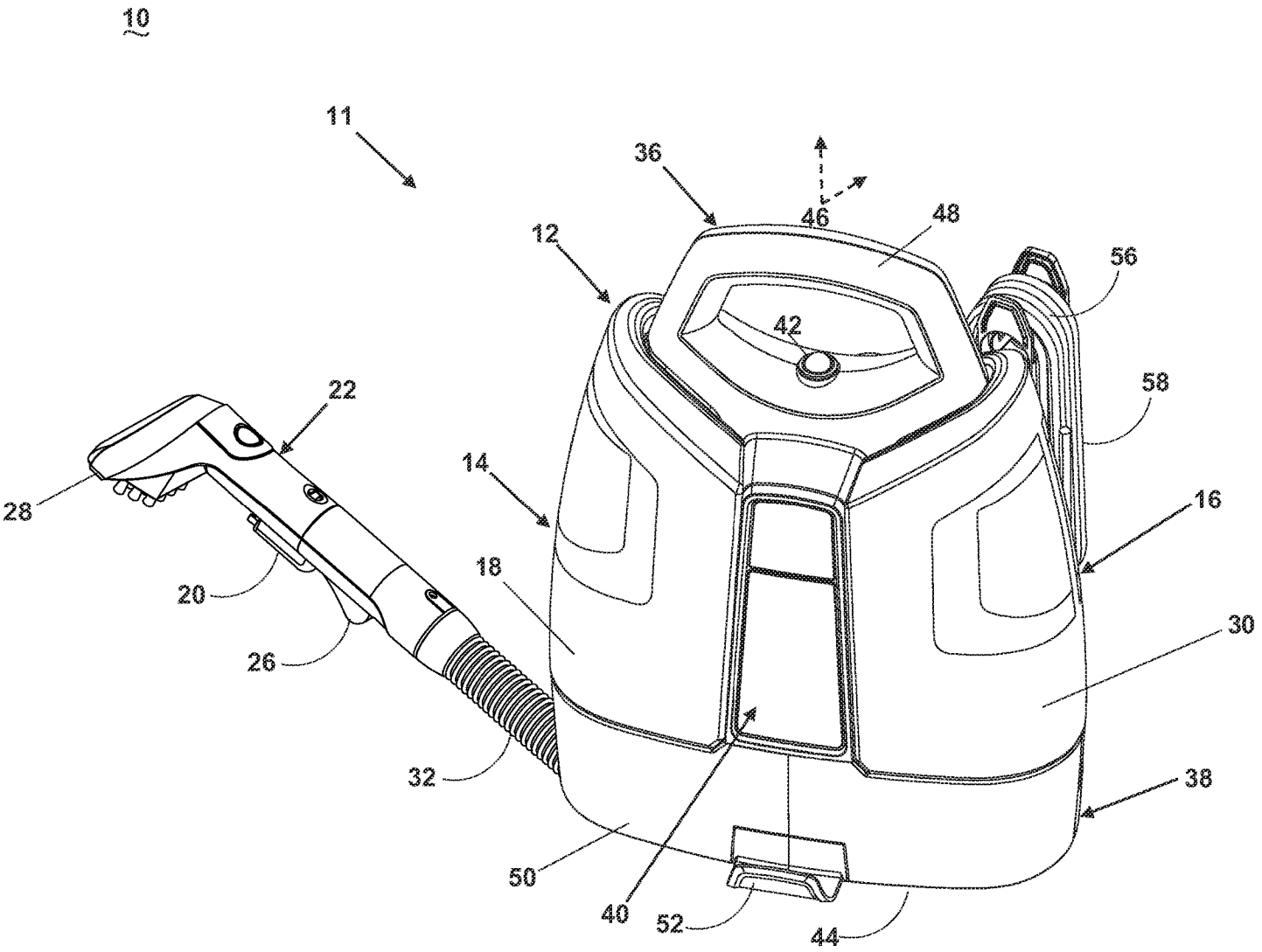
FIG. 1 is a perspective view of a surface cleaning apparatus in the form of a portable extraction cleaner according to various aspects described herein.
Figure 2:
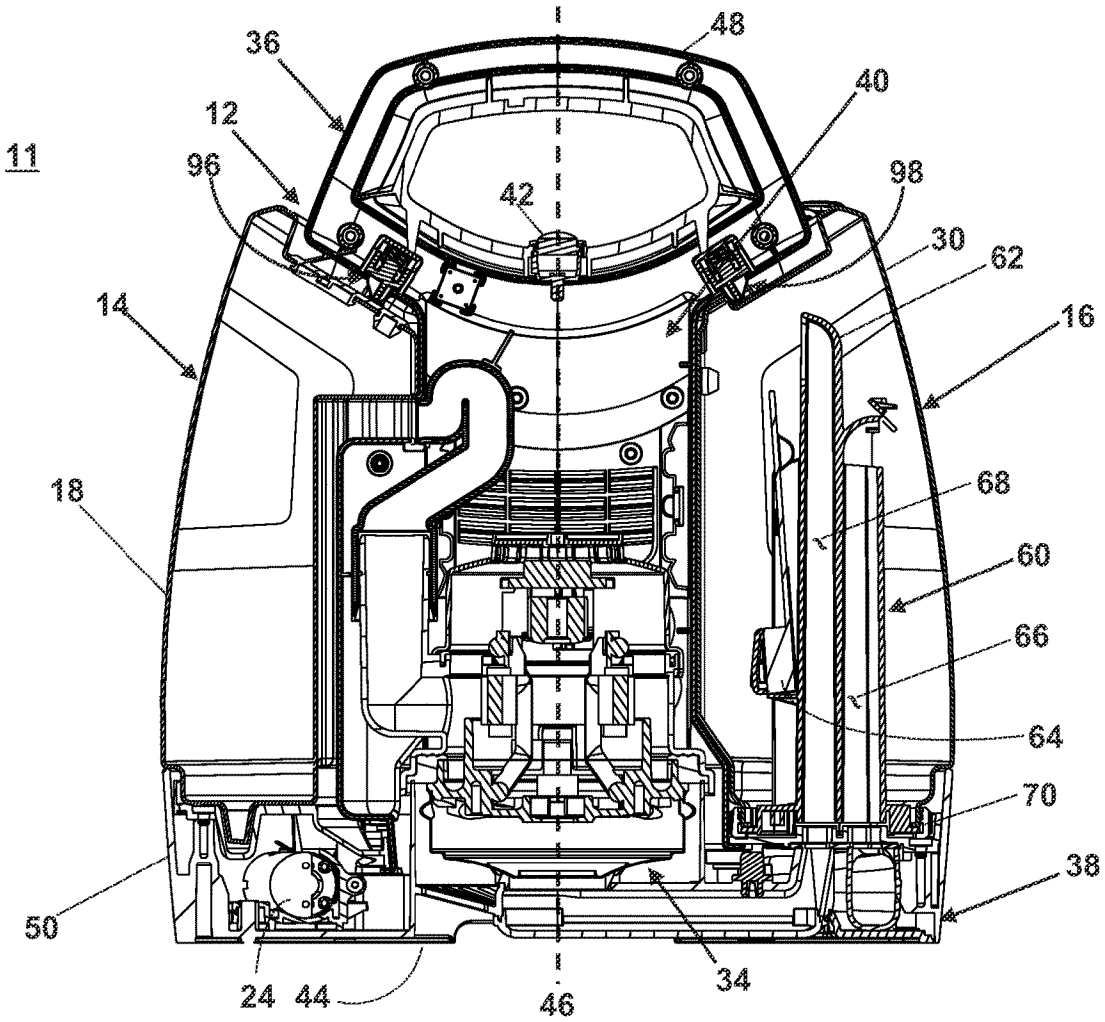
FIG. 2 is a cross-sectional view of the portable extraction cleaner through line II-II of FIG. 1.

FIGS. 1-2 show a surface cleaning apparatus 10 in the form of a portable extraction cleaner 11. The extraction cleaner 11 includes a main housing 12 selectively carrying a fluid delivery system 14 configured to store cleaning fluid and to deliver the cleaning fluid to the surface to be cleaned, and a fluid recovery system 16 configured to remove the cleaning fluid and debris from the surface to be cleaned and to store the recovered cleaning fluid and debris. The fluid delivery system 14 can more particularly be a liquid delivery system 14 configured to store cleaning liquid and to deliver the cleaning liquid to the surface to be cleaned.

For purposes of description related to the figures, the terms upper, lower, vertical, horizontal, and derivatives thereof shall relate to the exemplary extraction cleaner 11 as oriented in FIG. 1, with the extraction cleaner 11 resting on a surface or being carried by the carry handle. However, it is to be understood that aspects of the present disclosure may assume various alternative orientations, except where expressly specified to the contrary.

The main housing 12 is adapted to selectively mount components of the fluid delivery system 14 and the fluid recovery system 16 to form an easy-to-carry unit that can be transported by a user to different locations with surfaces to be cleaned. It is noted that while the extraction cleaner 11 is illustrated as a portable extraction cleaner, aspects of the disclosure may be applicable to other types of surface cleaning apparatus, including upright extraction cleaners having a base assembly for movement across a surface to be cleaned and a handle assembly pivotally mounted to a rearward portion of the base assembly for directing the base assembly across the surface to be cleaned, autonomous or robotic surface cleaning apparatus, surface cleaning apparatus which have steam delivery capability, and/or surface cleaning apparatus which have fluid delivery but not extraction capabilities, or vice versa.

The fluid delivery system 14 can include a supply tank 18 for storing a supply of cleaning fluid and a fluid distributor 20 provided on a hand-held tool 22 in fluid communication with the supply tank 18 for depositing a cleaning fluid onto the surface. The cleaning fluid stored by the supply tank 18 can comprise one or more of any suitable cleaning liquids, including, but not limited to, water, compositions, concentrated detergent, diluted detergent, etc., and mixtures thereof. For example, the fluid can comprise a mixture of water and concentrated detergent. The supply tank 18 can be refillable, and can be formed of a transparent or tinted translucent material, which permits a user to view the contents thereof. The supply tank 18 can comprise a blow-molded tank body.

Various combinations of optional components can be incorporated into the fluid delivery system 14, such as a fluid pump, a heater, and/or fluid control and mixing valves, as well as suitable conduits or tubing fluidly connecting the components of the fluid delivery system 14 together to effect the supply of cleaning fluid from the supply tank 18 to the fluid distributor 20. For example, in the illustrated example the fluid delivery system 14 can further comprise a flow control system for controlling the flow of fluid from the supply tank 18 to the fluid distributor 20. In one configuration, the flow control system can comprise a pump 24 which pressurizes the system 14. An actuator can be provided to dispense fluid from the fluid distributor 20. The actuator can, for example, include a trigger 26 on the hand-held tool 22. The actuator can be operably coupled to the pump 24 such that pressing the actuator will activate the pump 24, or can be operably coupled to a flow control valve which controls the delivery of fluid from the pump 24 to the distributor 20 such that pressing the actuator will open the valve.

The fluid recovery system 16 can include an extraction path in the form of an extraction nozzle 28 provided on the hand-held tool 22, which is adapted to be used on the surface to be cleaned, a recovery tank 30, and a flexible hose 32 defining a vacuum or suction conduit in fluid communication with the extraction nozzle 28 and the recovery tank 30. The hose 32 can also include an internal fluid conduit in fluid communication with the supply tank 18 and the fluid distributor 20 for delivering cleaning fluid via the internal conduit. The recovery tank 30 can be formed of a transparent or tinted translucent material, which permits a user to view the contents thereof. The recovery tank 30 can comprise a blow-molded tank body.

The fluid recovery system 16 further includes a suction source in the form of a motor/fan assembly 34 in fluid communication with the extraction nozzle 28 for generating a working airflow to draw liquid and entrained debris through the extraction path. The motor/fan assembly 34 can be provided fluidly downstream of the recovery tank 30, although other extraction paths are possible.

The supply and recovery tanks 18, 30 can be removably mounted on the main housing 12. The main housing 12 can include a carry handle 36 to form an easy-to-carry unit with the supply and recovery tanks 18, 30 that can be transported by a user to different locations with surfaces to be cleaned. The main housing 12 can further include a base 38 on which the supply and recovery tanks 18, 30 are at least partially supported, and a partition 40 extending upwardly from the base 38, between the supply and recovery tanks 18, 30. A button 42 can be provided adjacent the carry handle 36 and is operably coupled to one or more electrical components of the extraction cleaner 11, such as the pump 24 and/or the motor/fan assembly 34.

The base 38 can comprise a housing with a flat bottom 44 that is adapted to rest directly on a surface, such as a horizontal surface or floor surface. Conveniently, the carry handle 36 can be provided opposite the flat bottom 44 so that a user can easily pick up the extraction cleaner 11.

The partition 40 can comprising a housing that generally divides the extraction cleaner 11 into two halves, with a partition plane 46 extending through the center, i.e. the middle, of the partition 40. The supply and recovery tanks 18, 30 can be provided on opposing sides of the axis partition plane 46.

The partition 40 can include the carry handle 36 at an upper portion thereof, above the supply and recovery tanks 18, 30, which facilitates carrying the extraction cleaner 11 from one location to another. In one example, the carry handle 36 can define a handle grip 48 spaced above the supply and recovery tanks 18, 30, and the handle grip 48 can be positioned to not intersect the supply tank 18 or the recovery tank 30. The partition plane 46 can intersect the middle of the handle grip 48. Further, the tanks 18, 30 can be spaced along a direction that is parallel to the handle grip 48.

Either of the base 38 and the partition 40 can further define one or more internal chambers for receiving components of the extraction cleaner 11. For example, the base 38 can include an internal chamber for receiving the pump 24 and the partition 40 can include an internal chamber for receiving the motor/fan assembly 34.

The base 38 includes a skirt 50 having a hose clip 52 on one side thereof adapted to retain the suction hose 32 when it is wrapped around the skirt 50 for storage. A tool retaining bracket 54 (FIG. 3) can extend from the partition 40 and is adapted to retain the hand-held tool 22 coupled with the terminal end of the hose 32 when the hose 32 is wrapped around the skirt 50. A cord wrap caddy 56 can be provided on a side of the partition 40 for storing a power cord 58 which emerges from the interior of the partition 40 and can be used to provide power to electrical components, such as the pump 24 and/or the motor/fan assembly 34, of the extraction cleaner 11 from a source of power, such as a home power supply, upon actuation of the button 42. Alternatively, the extraction cleaner 11 can be powered by a portable power supply, such as a battery, upon actuation of the button 42.

The recovery tank 30 defines a recovery chamber and can include an air/liquid separator assembly 60 within the recovery chamber. The air/liquid separator assembly 60 comprises a stack 62 for guiding air and liquid through the recovery tank 30 and a float assembly 64 for selectively closing the extraction path through the recovery tank 30. The stack 62 includes an inlet conduit 66 which receives recovered air and liquid form the extraction nozzle 28, and opens into the interior of the tank 30, and an outlet conduit 68 which passes substantially clean air, and substantially no liquid, to the motor/fan assembly 34. The float assembly 64 is configured to close the extraction path through the outlet conduit 68 as the liquid level in the recovery tank 30 rises to prevent liquid from entering the motor/fan assembly 34.

A mechanical coupling can be provided between the recovery tank 30 and the air/liquid separator assembly 60 for facilitating easy separation of the two components, and is shown herein as a threaded collar 70 which screws onto a neck of the recovery tank 30 which defines an opening which receives the air/liquid separator assembly 60. Other non-limiting examples of suitable mechanical couplings include a bayonet coupling, a threaded coupling, a keyed coupling, and other quick coupling mechanisms.

Figure 3:
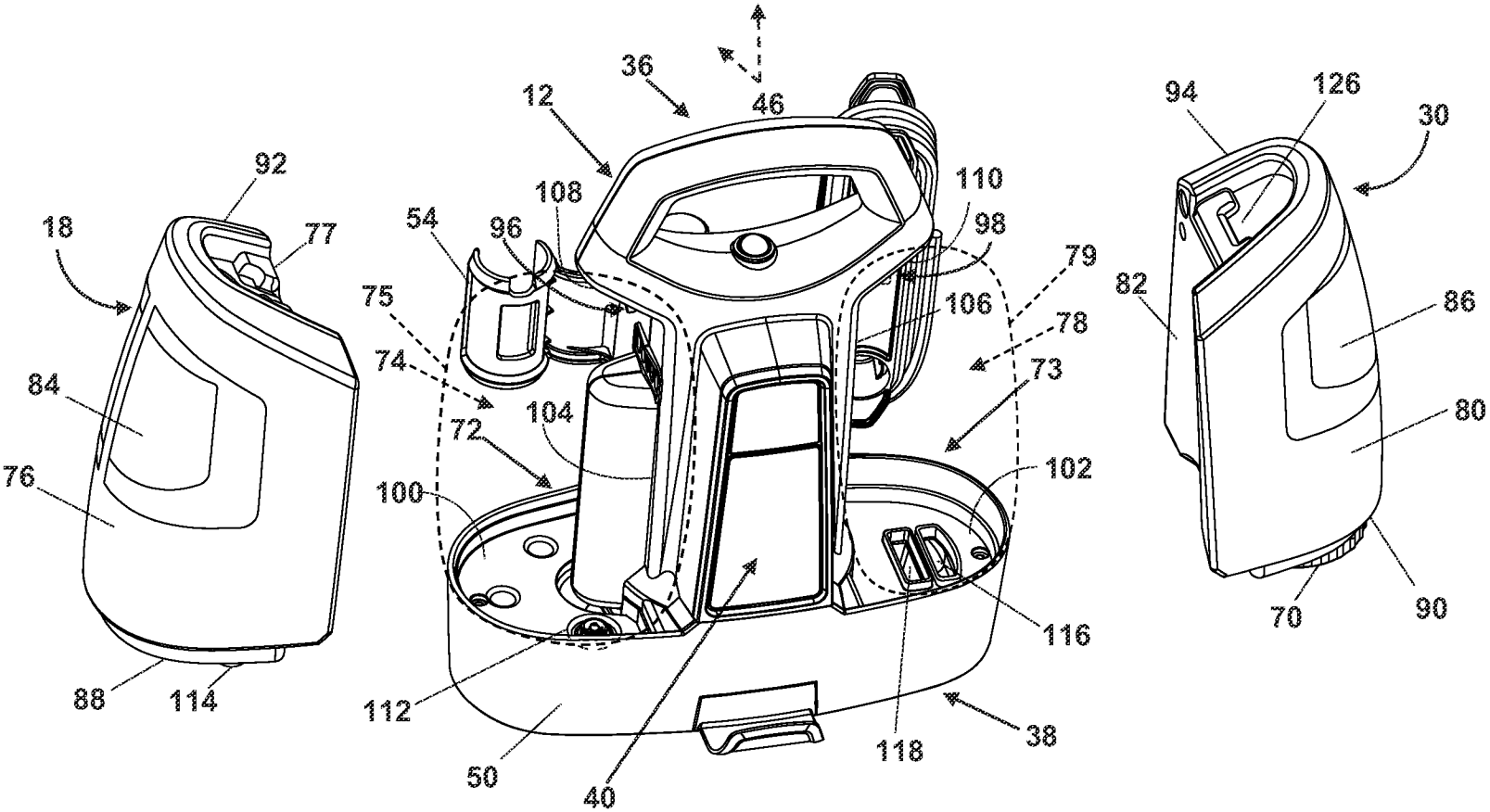
FIG. 3 is a partially-exploded view of the portable extraction cleaner from FIG. 1, showing a supply tank and a recovery tank exploded from a main housing assembly.

FIG. 3 is a partially-exploded view of the extraction cleaner 11 from FIG. 1. The main housing 12 comprises a supply tank receiver 72 and a recovery tank receiver 73 for respectively receiving the supply tank 18 and recovery tank 30. As shown, the tank receivers 72, 73 can be provided on opposing sides of the partition plane 46, on either side of the partition 40.

The supply tank receiver 72 can include a first void 74 within the main housing 12. More specifically, the first void 74 can be at least partially defined by portions of the base 38, partition 40, and the carry handle 36, or some combination thereof. The first void 74 can at least partially define a supply seat 75 for the supply tank 18.

It will be understood that the supply tank 18 can include a supply externally-facing surface 76 that forms an external surface of the extraction cleaner 11 when the supply tank 18 is seated in the supply tank receiver 72. The supply tank 18 can further include a supply internally-facing surface 77 which is internal to the extraction cleaner 11 when the supply tank 18 is seated in the supply tank receiver 72. The first void 74 can have a profile, surface, or geometry that is complementary to at least a portion of the supply internally-facing surface 77 including an entirety of the supply internally-facing surface 77. The first void 74 can be thought of as a cut-out within the main housing 12 within which the supply tank 18 can be at least partially received, fully received, or extend therefrom. As can be seen in FIG. 3, the first void 74 extends above the base 38, adjacent a side of the partition 40 and under a first overhanging wall formed by the carry handle 36.

In addition, the recovery tank receiver 73 can also include a second void 78 within the main housing 12. More specifically, the second void 78 can be at least partially defined by portions of the base 38, partition 40, and the carry handle 36, or some combination thereof. The second void 78 can at least partially define a recovery seat 79 for the recovery tank 30.

The recovery tank 30 can also include a recovery externally-facing surface 80 that forms an external surface of the extraction cleaner 11 when the recovery tank 30 is seated in the recovery tank receiver 73. The recovery tank 30 can further include a recovery internally-facing surface 82 which is internal to the extraction cleaner 11 when the recovery tank 30 seated in the recovery tank receiver 73. The second void 78 can have a profile, surface, or geometry that is complementary to at least a portion of the recovery internally-facing surface 82 including an entirety of the recovery internally-facing surface 82. The second void 78 can also be thought of as a cut-out within the main housing 12 within which the recovery tank 30 can be at least partially received, fully received, or extend therefrom. As can be seen in FIG. 3, the second void 78 extends above the base 38, adjacent a side of the partition 40 opposite the first void 74 and under a second overhanging wall formed by the carry handle 36.

Optionally, the supply and recovery tanks 18, 30 can have handgrip indentations 84, 86 formed in the externally-facing surfaces 76, 80. The supply and recovery tanks 18, 30 can further include respective lower ends 88, 90 and upper ends 92, 94, which may be formed of one or both of externally- and internally-facing surfaces 78-82.

A movable supply tank latch 96 can be provided on the supply tank receiver 72 for securing the supply tank 18 to the main housing 12. The recovery tank receiver 73 can also include a movable recovery tank latch 98 for securing the recovery tank 30 to the main housing 12. The supply and recovery tank latches 96, 98 facilitate correct installation and better sealing of both the supply and recovery tanks 18, 30, which alleviates user error and mis-assembly of the extraction cleaner 11. The supply and recovery tank latches 96, 98 can be configured to releasably latch or retain, but not lock, the supply and recovery tanks 18, 30 to the main housing 12, such that a user can conveniently apply sufficient force to the tanks 18, 30 themselves to pull the tanks 18, 30 off the main housing 12. In one example, the latches 96, 98 can comprise biased latches 96, 98 configured to release the tanks 18, 30 upon application of a sufficient force to overcome the biased latching force of the latches 96, 98. More specifically, the latches 96, 98 can comprise spring-biased latches.

In the illustrated example the tank receivers 72, 73 each respectively includes a platform 100, 102, a side wall 104, 106 of the partition 40, and first and second overhanging portions or walls 108, 110 of the partition 40 below the carry handle 36. The overhanging walls 108, 110 can extend outwardly from the respective side walls 104, 106 to overhang at least a portion of the respective platforms 100, 102. The platforms 100, 102 can be raised areas of the base 38 separated by the partition 40, and can be defined by upper portions of the base 38 surrounded by portions of the skirt 50.

The lower ends 88, 90 of the tanks 18, 30 can comprise one or more internally-facing flat surfaces adapted to rest on the platform 100, 102 of their respective receiver 72, 73. The upper ends 92, 94 of tanks 18, 30 can comprise one or more internally-facing surfaces adapted to confront the overhanging wall 108, 110 when the tanks 18, 30 are installed on the main housing 12.

The supply and recovery tank latches 96, 98 can be provided on the partition 40 of the main housing 12. More specifically, the latches 96, 98 can be provided on a corresponding underside of the overhanging walls 108, 110 of the receivers 72, 73. When the supply tank 18 is seated within the supply tank receiver 72, the supply tank 18 rests on the first platform 100 adjacent the first side wall 104 of the partition 40 and adjacent the first overhanging wall 108, and is retained in place by the supply tank latch 96 on the first overhanging wall 108. When the recovery tank 30 is seated within the recovery tank receiver 73, the recovery tank 30 rests on the second platform 102 adjacent the second side wall 106 of the partition 40 and adjacent the second overhanging wall 110, and is retained in place by the recovery tank latch 98 on the second overhanging wall 110. Alternatively, the supply and recovery tank latches 96, 98 can be provided elsewhere on the supply and recovery tank receivers 72, 73.

A valve seat 112 (partially shown in phantom line in FIG. 3) can be formed in the supply tank receiver 72, such as in the first platform 100, for fluidly coupling the pump 24 with the supply tank 18 when it is seated within the supply tank receiver 72. The supply tank 18 can include a valve 114 at an outlet thereof configured be received by the valve seat 112. The valve 114 can be adapted to open when the supply tank 18 is seated within the supply tank receiver 72 and to close when the supply tank 18 is removed from the supply tank receiver 72.

A liquid port 116 and a suction port 118 can be formed in the recovery tank receiver 73, such as in the second platform 102, for fluidly coupling with the inlet conduit 66 and outlet conduit 68, respectively, of the stack 62, when the recovery tank 30 is seated within the recovery tank receiver 73.

Figure 4:
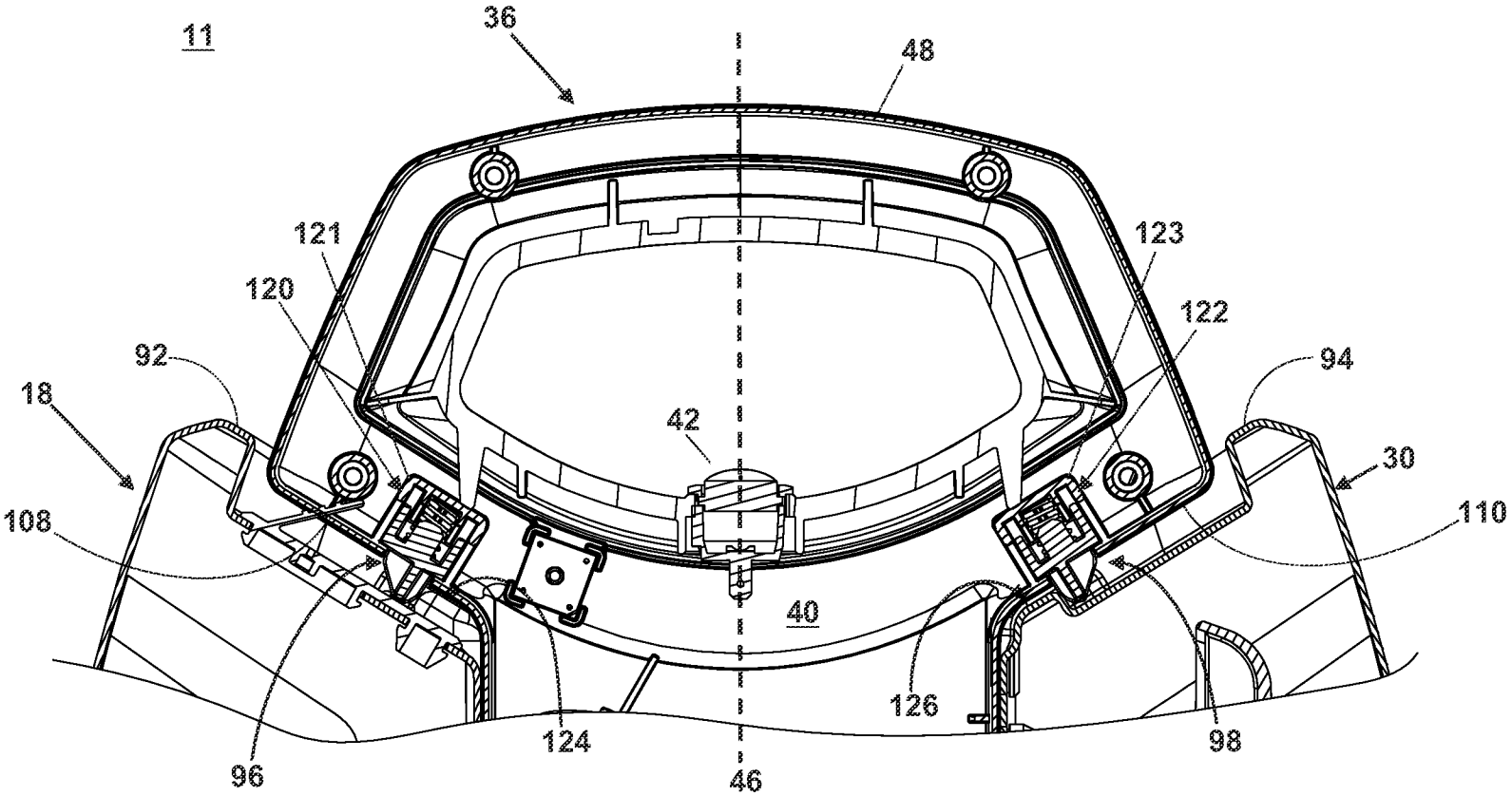
FIG. 4 is a close-up view of a portion of FIG. 2, illustrating latches for the supply tank and recovery tank.

Referring to FIG. 4, the partition 40 includes pockets 120, 122 formed therein for mounting the latches 96, 98. More specifically, the pockets 120, 122 can be provided beneath the carry handle 36, and can be formed in the overhanging walls 108, 110 of the receivers 72, 73. The pockets 120, 122 can include respective contoured portions 121, 123 facing the supply and recovery tanks 18, 30. The supply tank latch 96 and recovery tank latch 98 can be at least partially retained within the respective pockets 120, 122. In the example shown, the pockets 120, 122 are generally U-shaped with rounded inner corners; however, other geometric profiles can be utilized, including a shallow pocket with small side walls and sharp corners, or an irregular profile with non-symmetric side walls and beveled or rounded corners, in non-limiting examples.

Figure 6:
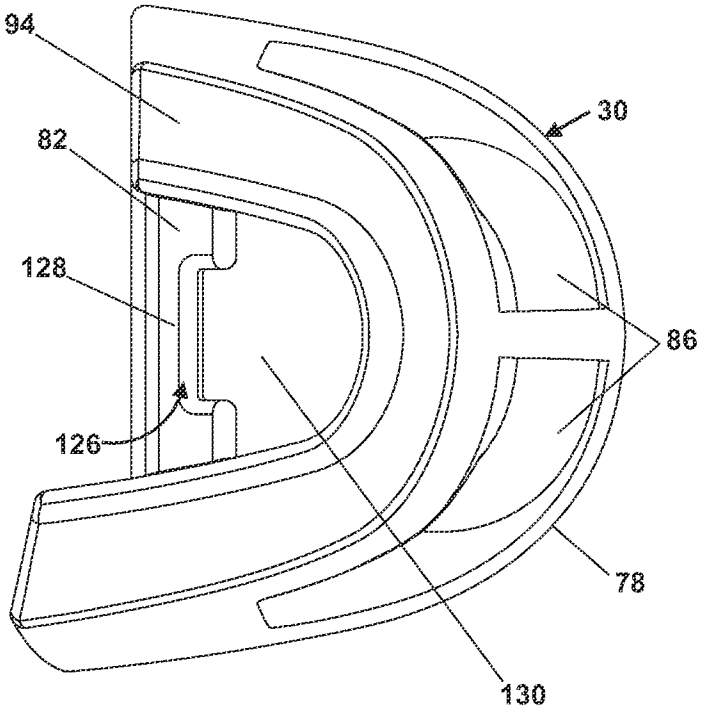
FIG. 6 is a top view of the recovery tank.
Figure 5:
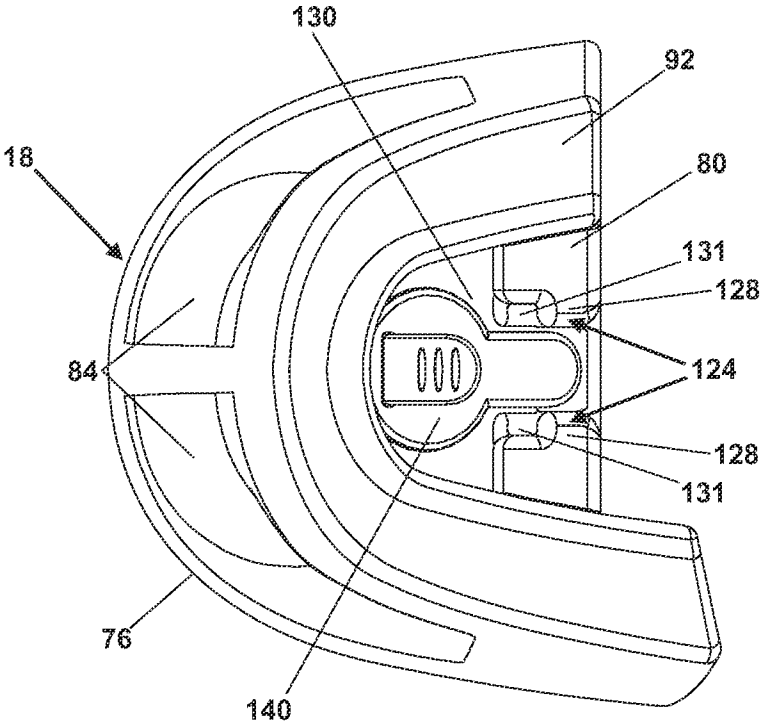
FIG. 5 is a top view of the supply tank.

Referring additionally to FIGS. 5-6, each of the supply and recovery tanks 18, 30 includes a respective supply and recovery catch 124, 126 for the supply and recovery tank latches 96, 98. The catches 124, 126 are configured to be retained by the corresponding latches 96, 98 to releasably hold the supply and recovery tanks 18, 30 in the corresponding tank receivers 72, 73. The catches 124, 126 can be formed on one of the internally-facing surfaces 80, 82 of the tanks 18, 30 such that the catches 124, 126 and latches 96, 98 are hidden when the tanks 18, 30 are seated in the receivers 72, 73. In an example where the supply and recovery tanks 18, 30 comprise blow-molded tank bodies, the catches 124, 126 can be formed integrally in an upper portion of the blow-molded tank bodies forming the upper end 92, 94 of the tanks 18, 30.

Figure 7:
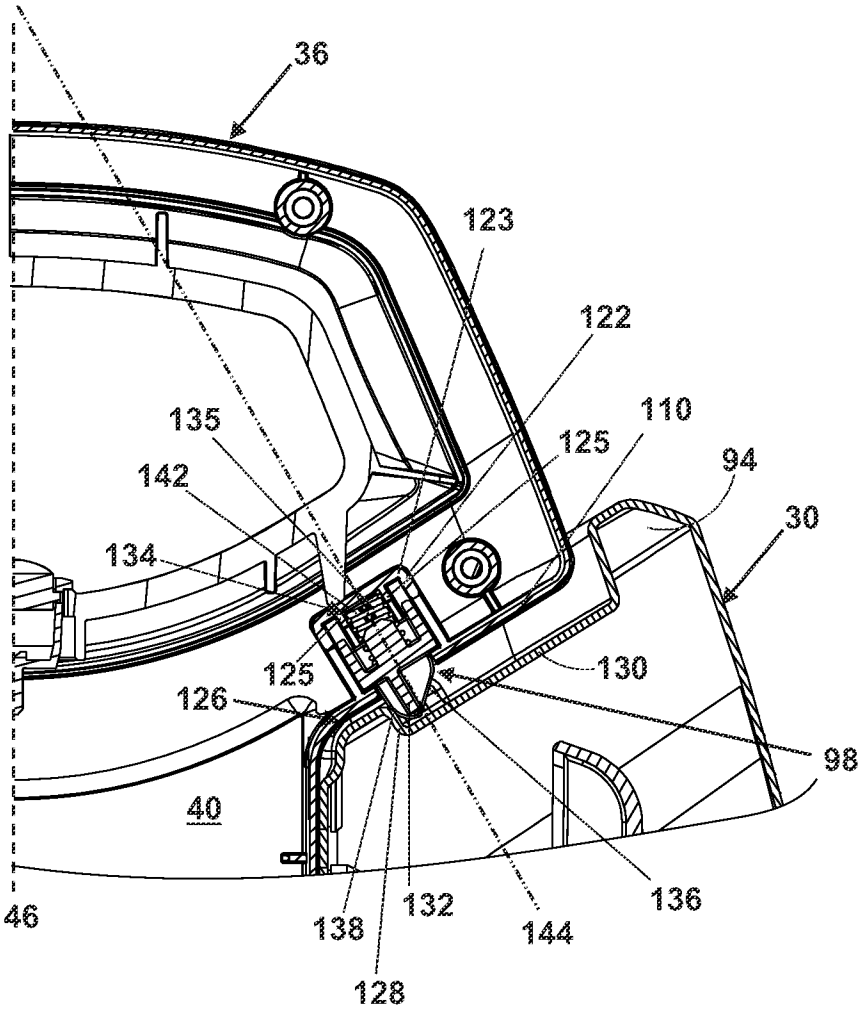
FIG. 7 is a close-up view of a portion of FIG. 2, illustrating the latch for the recovery tank.

Referring to FIG. 7, further details of the supply and recovery tank latches 96, 98 and the supply and recovery catches 124, 126 will now be described relative to the recovery tank 30. While only the recovery tank 30 is illustrated for clarity, it will be understood that the recovery tank latch 98 and recovery catch 126 is similar to the supply tank latch 96 and supply catch 124. Therefore, the description of the recovery tank latch 98 and recovery catch 126 applies to the supply tank latch 96 and supply catch 124, unless otherwise noted.

The catch 126 can be provided at the upper end 94 of the tank 30, which confronts the overhanging wall 110, and can comprise at least one raised angled surface 128 adjacent a recess 130 defined by the upper end 94 of the tank 30. As shown in FIG. 5, the catch 124 of the supply tank 18 can also comprise a pair of raised angled surfaces 128 adjacent a pair of recesses 131 due to the presence of a fill cap 140 for the supply tank 18. The catch 126 can also receive at least a portion of the recovery overhanging wall 110 within the recess 130.

The latch 98 can include a latch member 132 and a biasing member 134 configured to bias the latch member 132 outwardly from the pocket 122 in a generally downward direction. The latch 98 can include a spring-biased latch, and the biasing member 134 can specifically comprise a spring, such as a coil spring 135. A spring cavity 142 for retaining the coil spring 135 between the latch member 132 and the main housing 12 can be formed by portions of the latch member 132 and the pocket 122. For example, prong members 125 can be provided on the contoured portion 123 of the pocket 122 and at least partially define the spring cavity. The coil spring 135 can be retained between the prong members 125 within the spring cavity 142, and can also be retained between the latch member 132 and the contoured portion 123 of the pocket 122.

The latch member 132 is constrained at its upper end by the coil spring 135. In addition, the lower end of the latch member 132 comprises a first wall 136 and a second wall 138, with the first wall 136 facing outwardly from the partition 40 and the second wall 138 facing inwardly toward the partition 40. The first wall 136 comprises an angled or ramped lead-in portion for engaging the upper end 94 of the recovery tank 30, via an interference fit, when the latch member 132 is in its extended position during installation. The second wall 138 can be orthogonal to the catch 126, and in particular orthogonal to the raised angled surface 128, for retaining the tank 30. The first wall 136 can be an outer wall facing outwardly away from the partition 40, and the second wall 138 can be an inner wall facing inwardly toward away the partition 40. While not shown in this example, it is also contemplated that the first or second walls 136, 138 of the latch member 132 can also include vertically projecting portions. In the example of FIG. 5 where the supply catch 124 includes multiple recesses 131 adjacent angled raised surfaces 128, the first and second walls 136, 138 can be formed with corresponding projections or "teeth" to extend into the recesses 131 while accommodating the intermediate raised space therebetween due to the presence of the fill cap 140. The projections 297 define two points of contact that provide interference with the supply tank 218 to retain the supply tank 218 within the seat 275. The projecting portions can define multiple points of contact that provide interference with the supply tank 18 to retain the supply tank 18 within the seat 75. In addition, such vertically projecting portions can also be provided in the latch member 132 of the recovery tank 30, even in an example where the catch includes a single raised surface and recess.

The latch member 132 is moveable relative to the pocket 122 and is constrained by the pocket 122 for axial movement along a latch axis 144. In one example, the latch axis 144 intersects the carry handle 36, and can further intersect the partition plane 46 at an angle.

In the illustrated example the tanks 18, 30 and latches 96, 98 are arranged side-by-side, and may be parallel to each other. The latches 96, 98 are arranged to operate in opposing directions so that a user can, if desired, grab one of the tanks 18, 30 in each hand, and pull the tanks 18, 30 away from the main housing 12 simultaneously. Similarly, the user can install the tanks 18, 30 simultaneously. The upper ends 92, 94 of the tanks 18, 30 can also be angled in opposing directions to facilitate lifting the tanks 18, 30 away and up from the receivers 72, 73 separated by the partition 40. The latches 96, 98 can be operable along latch axes 144 that intersect the carry handle 36.

In operation, the extraction cleaner 11 can be used to treat a surface to be cleaned by applying a cleaning fluid to the surface from the supply tank 18 and extracting the cleaning fluid from the surface into the recovery tank 30. This can be done alternately, by first applying cleaning fluid to the surface and scrubbing the surface, and then extracting debris-containing fluid from the surface. For cleaning fluid application, when power is applied to the pump 24 and the trigger 26 is pressed, cleaning fluid is distributed from the supply tank 18 to the surface to be cleaned via the fluid distributor 20. The hand-held tool 22 can be used to agitate or scrub the surface. For extraction, when power is applied to the motor/fan assembly 34, a suction force is generated in the extraction path. Suction force at the extraction nozzle 28 of the tool 22 draws debris-containing fluid, which can contain air and liquid into the recovery tank 30. Liquid and debris in the fluid fall under the force of gravity to the bottom of the recovery tank 30. The air drawn into the recovery tank 30, now separated from liquid and debris, exits the recovery tank 30 and continues with the extraction path to an exhaust outlet (not shown) in the main housing, whereupon the air exits the extraction cleaner 11.

Figure 8:
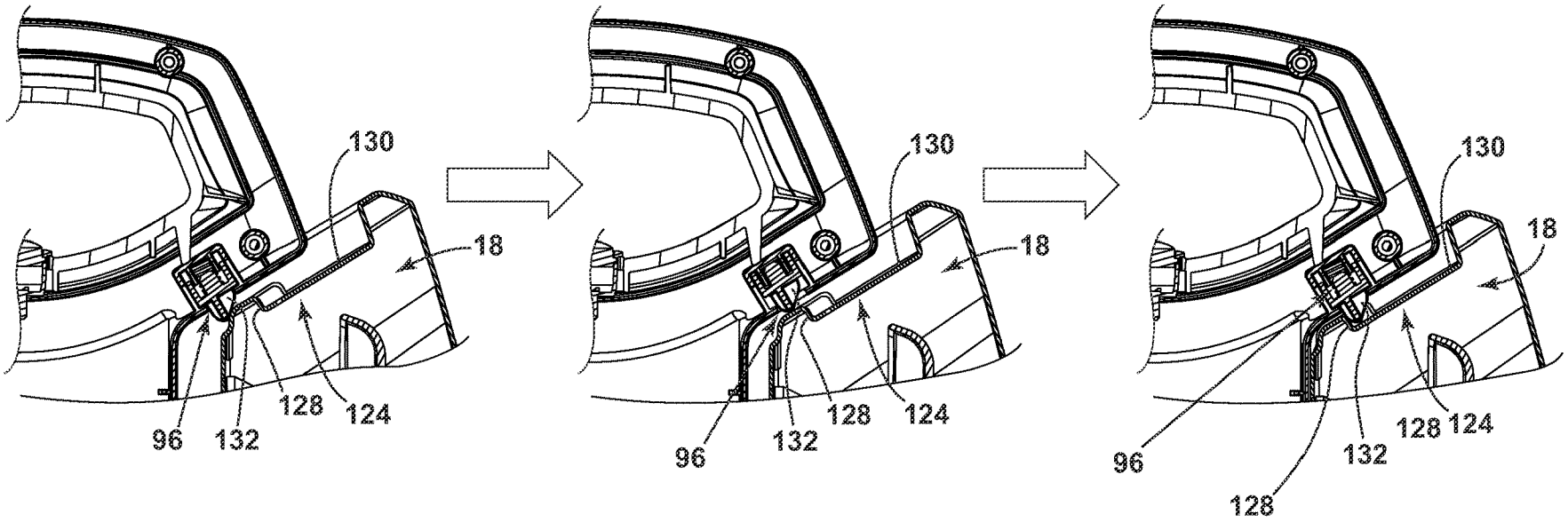
FIG. 8 is a perspective view of the portable extraction cleaner of FIG. 1 illustrating an installation of the recovery tank on the main housing assembly.

With reference to FIGS. 4 and 8, prior to operation, the tanks 18, 30 can be installed on the main housing 12 in accordance with the following method. It should be understood that only installation of the recovery tank 30 is shown in FIG. 8 for clarity, and that the following description can also apply to installation of the supply tank 18. During installation of the recovery tank 30, the angled lead-in portion of the first wall 136 rides over the recovery catch 124, 126 and causes the latch member 132 to compress the coil spring 135, and retract into the pocket 120, 122. When the tanks 18, 30 are seated, the second wall 138 of the latch member 132 mates with the side of the raised surface 128 forming the catch 124, 126. The biasing member 134, e.g. the coil spring 135, forces the latch member 132 to extend out of the pocket 120, 122 and into the latched position shown in FIG. 4. Put another way, the biasing member 134 can bias the latch member 132 into its extended position, away from the pocket 120, 122, such that the latch member 132 can be releasably retained in the recess 130.

To remove one or both of the tanks 18, 30, the user can conveniently apply sufficient force to the tanks 18, 30 themselves, such as by gripping the handgrip indentations 84, 86 or pulling outward on the supply upper end 92, to pull the tanks 18, 30 off the main housing 12. Upon application a sufficient force via engagement of the catch 124, 126 with the second wall 138 to overcome the biasing force of the biasing member 134, the latch member 132 is forced deeper into the pocket 120, 122 and clears the catch 124, 126, thereby releasing the tank 18, 30 to be lifted away from the main housing 12.

Figure 9:
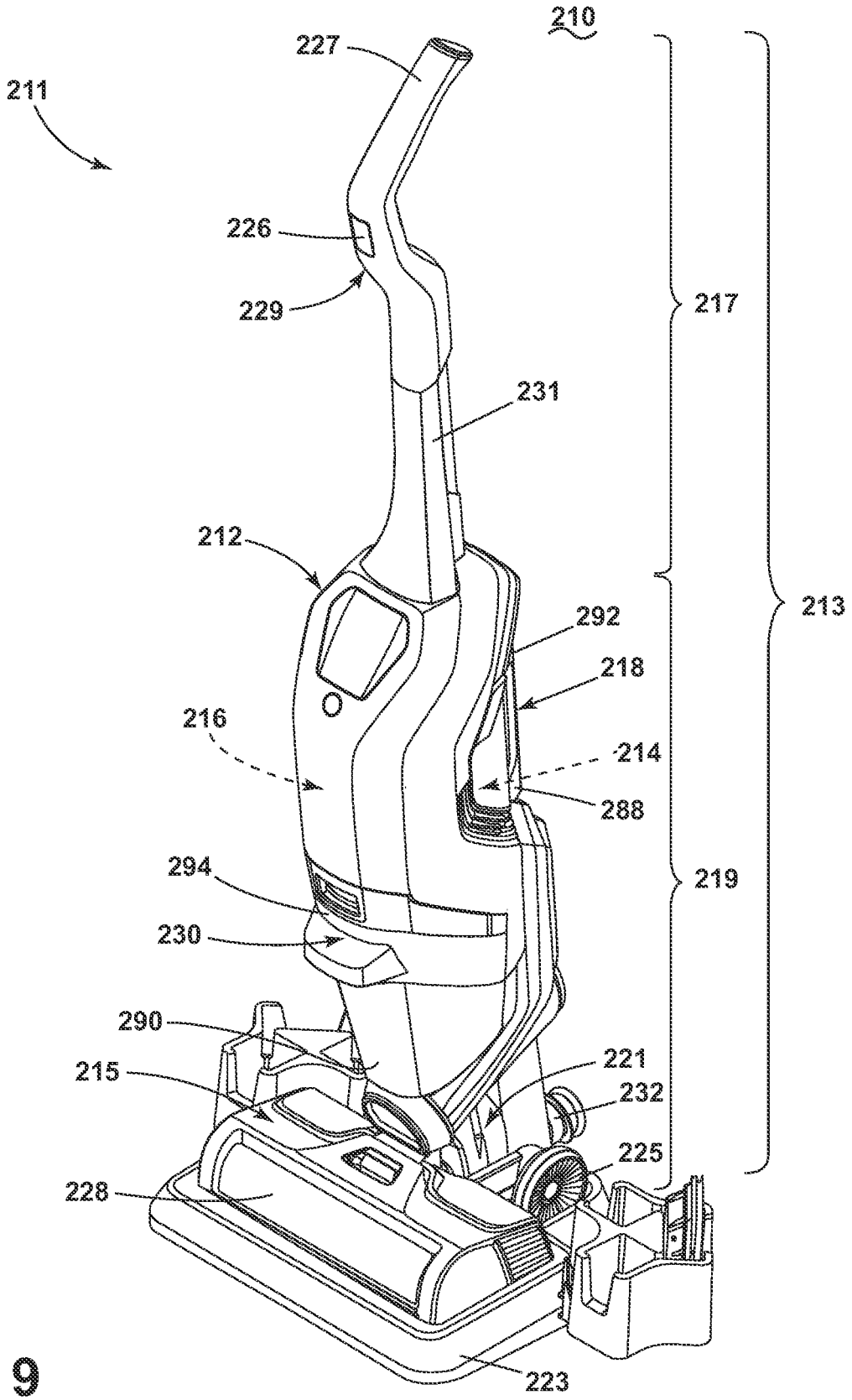
FIG. 9 is a perspective view of another surface cleaning apparatus in the form of an upright extraction cleaner according to various aspects described herein.

Referring now to FIG. 9, another surface cleaning apparatus 210 is illustrated in the form of an upright extraction cleaner 211. The surface cleaning apparatus 210 is similar to the surface cleaning apparatus 10; therefore, like parts will be identified with like numerals increased by 200, with it being understood that the description of the like parts of the surface cleaning apparatus 10 applies to the surface cleaning apparatus 210, except where noted.

The upright extraction cleaner 211 includes an upright handle assembly 213 and a base or cleaning head 215 pivotally mounted or swivel mounted to the upright handle assembly 213 and adapted for movement across a surface to be cleaned. For purposes of description related to the figures, the terms "upper," "lower," "right," "left," "rear," "front," "vertical," "horizontal," "inner," "outer," and derivatives thereof shall relate to the upright extraction cleaner oriented in FIG. 1 from the perspective of a user behind the upright extraction cleaner 211, which defines the rear of the upright extraction cleaner 211.

The upright handle assembly 213 comprises an upper handle 217 and a frame 219. The frame 219 includes a main housing 212 supporting at least a supply tank 218 having a supply upper end 292 opposite a supply lower end 288, as well as a recovery tank 230 having a recovery upper end 294 opposite a recovery lower end 290. The upright extraction cleaner 211 can include a fluid delivery system 214, including and at least partially defined by the supply tank 218, for storing cleaning fluid and delivering the cleaning fluid to the surface to be cleaned. The upright extraction cleaner 211 can also include a fluid recovery system 216 and a fluid recovery pathway, including and at least partially defined by the recovery tank 230, for removing the spent cleaning fluid and debris from the surface to be cleaned and storing the spent cleaning fluid and debris until emptied by the user. The recovery tank 230 can be removably mounted to the front of the main housing 212. Optionally, a tray 223 can be provided to house or store the upright extraction cleaner 211 as well as any additional components such as extra brushrolls, suction nozzles, or accessory tools.

A pivotable or swivel joint assembly 221 is formed at a lower end of the frame 219 and moveably mounts the cleaning head 215 to the upright handle assembly 213. In the illustrated example, the cleaning head 215 can pivot up and down about at least one axis relative to the upright handle assembly 213. The pivotable swivel joint assembly 221 can alternatively comprise a universal joint, such that the cleaning head 215 can pivot about at least two axes relative to the upright handle assembly 213. Wiring and/or conduits supplying air and/or liquid between the cleaning head 215 and the upright handle assembly 213, or vice versa, can extend though the pivotable swivel joint assembly 221. A swivel locking mechanism (not shown) can optionally be provided to lock and/or release the swivel joint assembly 221 for movement. A flexible conduit hose 232 can couple the recovery tank 230 to the cleaning head 215 and can also pass through the swivel joint assembly 221.

The cleaning head 215 comprises a removable suction nozzle assembly 228 that can be adapted to be adjacent the surface to be cleaned as the cleaning head 215 moves across the surface and is in fluid communication with the recovery tank 230 through the flexible conduit hose 232. Optionally, an agitator (not shown) can be provided in the suction nozzle assembly 228 for agitating the surface to be cleaned. Some examples of agitators include, but are not limited to, a horizontally-rotating brushroll, dual horizontally-rotating brushrolls, one or more vertically-rotating brushrolls, or a stationary brush. A pair of rear wheels 225 are positioned for rotational movement about a central axis on the rearward portion of the cleaning head 215 for maneuvering the upright extraction cleaner 211 over a surface to be cleaned.

The upright handle assembly 213 can include a handgrip 227 and a user interface 229. The user interface 229 can also be provided elsewhere on the upright extraction cleaner 211, such as on the main housing 212. The user interface 229 can be any configuration of actuating controls such as but not limited to buttons, triggers, toggles, switches, or the like, operably connected to systems in the upright extraction cleaner 211 to affect and control function. In the example shown, the user interface 229 includes a push-button trigger 226.

The upright handle assembly 213 can further include a hollow handle pipe 231 that extends vertically and connects the upright handle assembly 213 to the main housing 212. The lower end of the handle pipe 231 terminates into an upper portion of the main housing 212.

Figure 10:
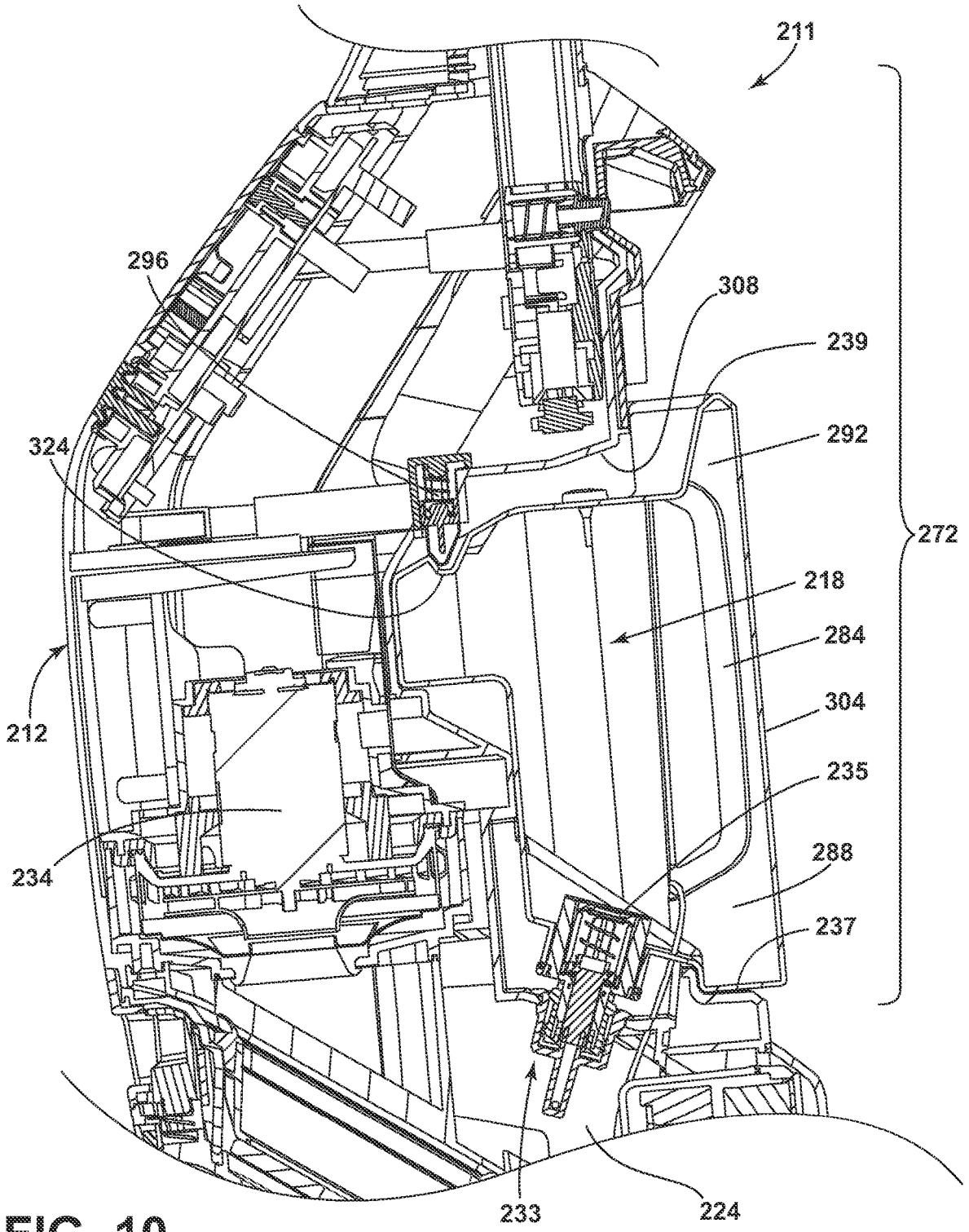
FIG. 10 is a side cross-sectional view of the upright extraction cleaner of FIG. 9 illustrating a supply tank seated within a main housing assembly.

Turning to FIG. 10, a portion of the upright extraction cleaner 211 is shown in cross-section, with portions of the main housing 212 and supply tank 218 visible. The supply tank 218 includes a bottom wall 237 at the lower end 288 and a top wall 239 at the upper end 292. A side wall 304 can extend from the bottom wall 237 toward the upper end 292 of the supply tank 218. Indentations 284 can be included in the supply tank 218 and can be configured to form a grip or handgrip for a user such that a user can remove the supply tank 218. For example, indentations 284 can be formed in each side wall 304 of the supply tank 218.

A pump 224 can be provided within the main housing 212 beneath, and in fluid communication with, the supply tank 218 for pressurizing the fluid delivery system 214. In one example, actuation of the trigger 226 (FIG. 9) can provide for selective fluid delivery from the supply tank 218 via the pump 224. In addition, a motor/fan assembly 234 can be mounted to an upper portion of the main housing 212. The motor/fan assembly 234 can be in fluid communication with the recovery tank 230, and optionally the motor/fan assembly 234 can be provided within a dedicated motor housing. Optionally, a heater (not shown) can be provided for heating the cleaning fluid prior to delivering the cleaning fluid to the surface to be cleaned. In one example, an in-line heater can be located downstream of the supply tank 218, and upstream or downstream of the pump 224. Other types of heaters can also be used. In yet another example, cleaning fluid can be heated using exhaust air from a motor-cooling pathway for the motor/fan assembly 234.

A supply valve assembly 233 can be provided for controlling fluid flow through an outlet 235 of the supply tank 218. Alternatively, the supply tank 218 can include multiple supply chambers, such as one chamber containing water and another chamber containing a cleaning agent. The supply valve assembly 233 can open to release fluid to the fluid delivery pathway. For example, the supply valve assembly 233 can be configured to automatically open when the supply tank 218 is seated. Optionally, a screen mesh insert (not shown) can be provided between the supply tank outlet 235 and the supply valve assembly 233 to prevent particulates above a certain size from entering the pump 224.

In the illustrated example, a supply tank receiver 272 can be provided at an upper portion of the main housing 212 for receiving the supply tank 218. The supply tank receiver 272 can include an overhanging portion or wall 308 that is spaced from the upper end 292 of the supply tank 218 when the supply tank 218 is seated in its receiver 272.

A movable supply tank latch 296 can be provided on the supply tank receiver 272 for securing the supply tank 218 to the main housing 212. The supply tank latch 296 can be configured to releasably latch or retain the supply tank 218 to the main housing 212. The supply tank 218 can include a supply catch 324 configured to be retained by the supply tank latch 296, such that the supply tank 218 can be releasably held in the tank receiver 272. The supply catch 324 can be formed in the top wall 239 of the supply tank 218 confronting the supply overhanging wall 308. In this manner, the catch 324 and latch 296 can be hidden when the supply tank 218 is seated in the tank receiver 272.

Figure 11:
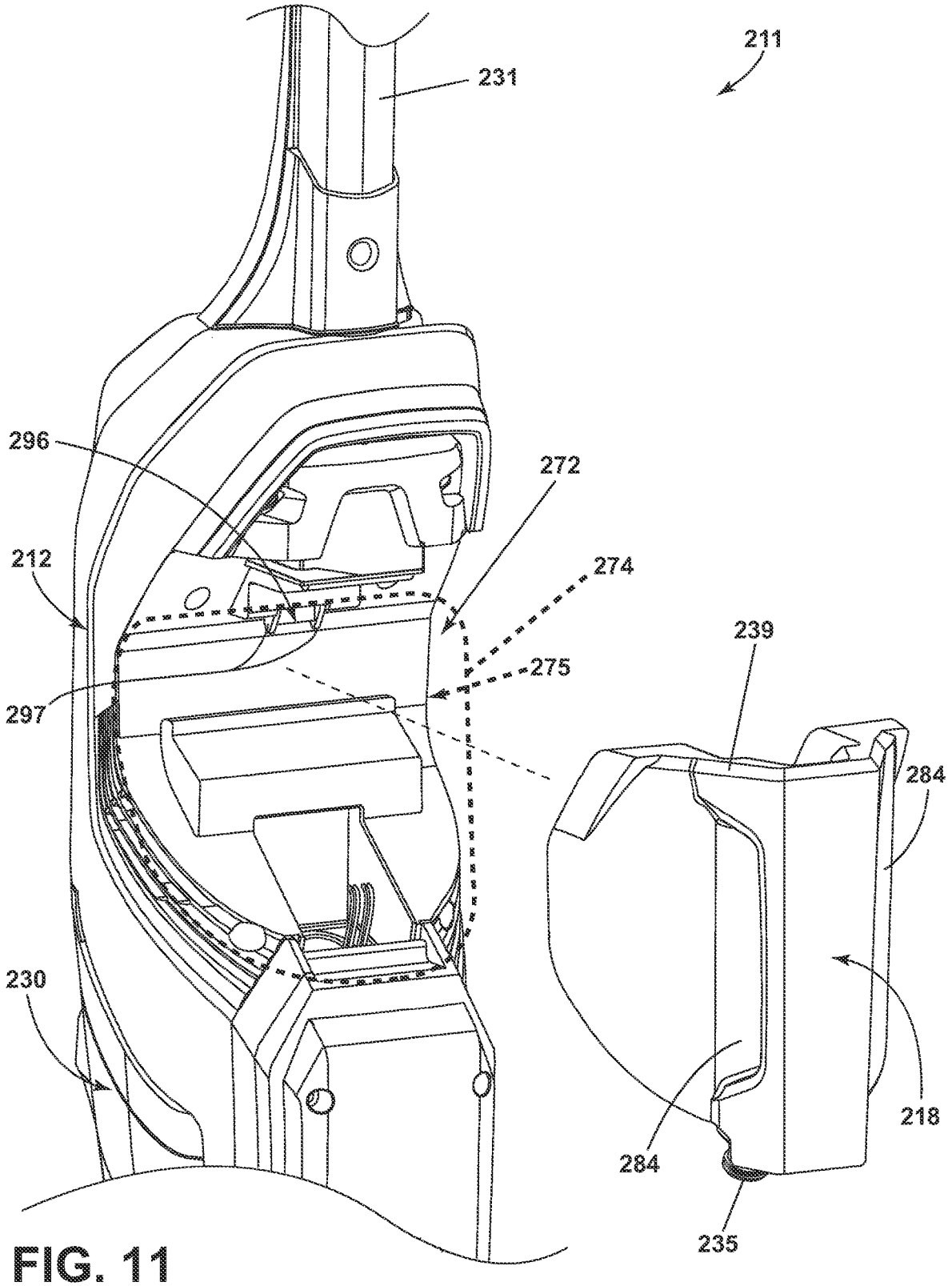
FIG. 11 is a partially-exploded rear view of the upright extraction cleaner of FIG. 9 illustrating the supply tank exploded from the main housing assembly.

FIG. 11 illustrates removal of the supply tank 218 from the supply tank receiver 272. The supply tank receiver 272 can further include a void 274 at least partially defined by portions of the main housing 212. The void 274 can at least partially define a seat 275 for the supply tank 218.

Figure 12:
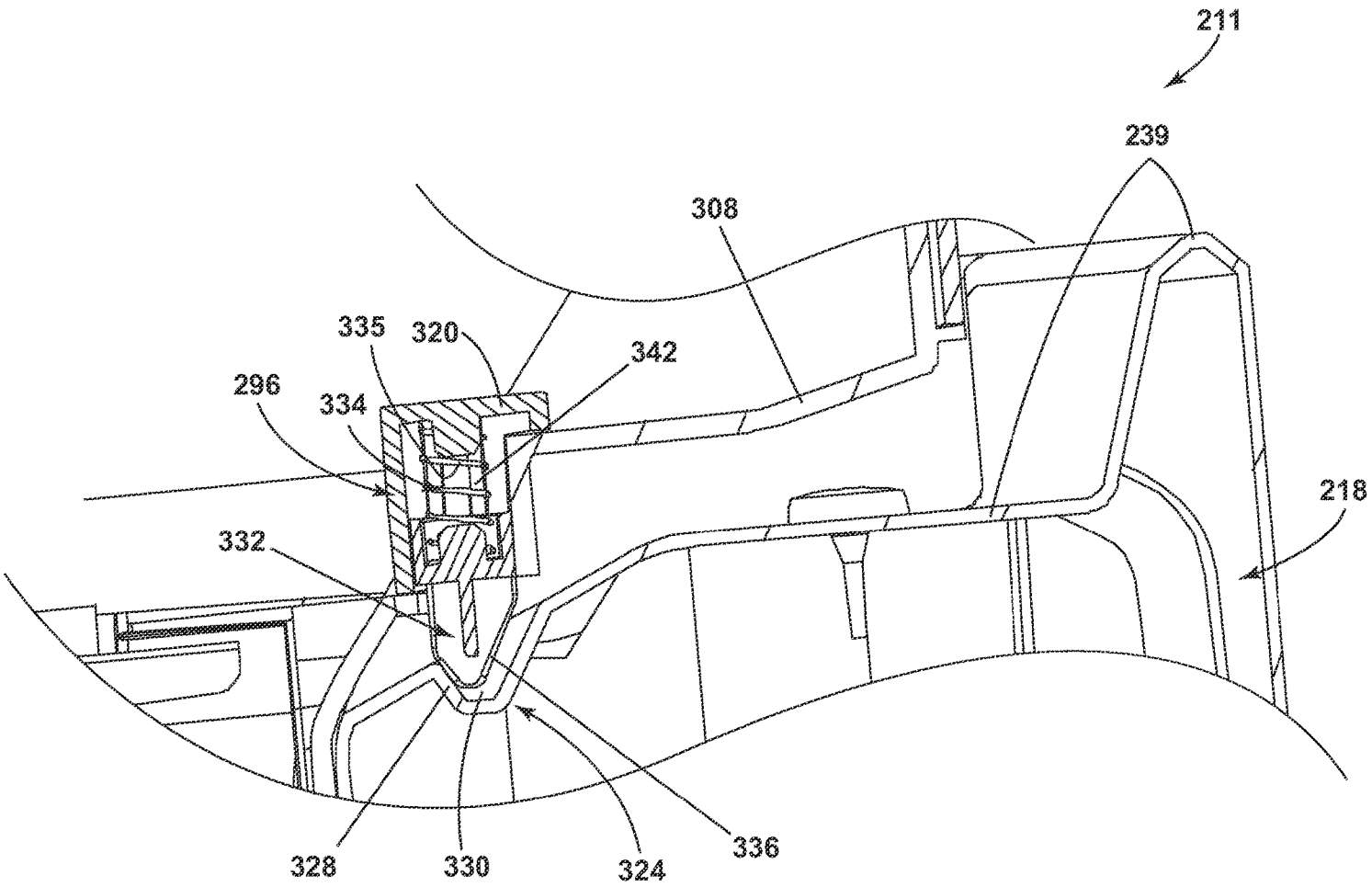
FIG. 12 is a side cross-sectional view of a portion of the upright extraction cleaner of FIG. 11 illustrating a latch for the supply tank.

The latch 296 can include a biased latch member 332 and a biasing member 334 configured to bias the latch member 332 in a direction toward the supply tank 218. The latch member 332 can be configured to release the supply tank 218 upon application of a sufficient force to overcome the biased latching force of the supply tank latch 296. Additionally, in the example shown the latch member 332 can include a pair of latch projections 297 at its distal end that can simultaneously extend or retract into a pocket 320 (FIG. 12). The latch projections 297 define two points of contact that provide interference with the supply tank 218 to retain the supply tank 218 within the seat 275.

To remove the supply tank 218, a user can grasp the handgrip indentations 284 or the top wall 239 of the supply tank 218 and pull outward, away from the main housing 212, with sufficient force to overcome the biasing force of the biasing member 334 and cause the latch member 332 to retract into the pocket 320. In this manner the supply tank 218 can be released from the seat 275 and removed from the main housing 212.

FIG. 12 illustrates additional details of the supply tank latch 296 and supply catch 324. A pocket 320 can be formed in the overhanging wall 308 for retaining the supply tank latch 296. The supply tank latch 296 can include a coil spring 335 housed within a spring cavity 342 formed within the pocket 320 (FIG. 12). In this manner the latch member 332 can move between extended and retracted positions within the pocket 320.

The supply catch 324 can include at least one raised angled surface 328 adjacent a recess 330 defined by the top wall 239 of the supply tank 218. The latch member 332 can include a wall 336 having an angled or ramped lead-in portion. The wall 336 can engage the top wall 239 of the supply tank 218, via an interference fit, when the latch member 132 is in its extended position. It is also contemplated that the latch projections 297 (FIG. 11) can be formed out of the wall 336. During installation, the latch member 332 can slide over the top wall 239 of the supply tank 218 and extend, via the coil spring 335, into the recess 330 formed by the supply catch 324 when the supply tank 218 is fully seated within the receiver 272.

Aspects of the disclosure provide for several benefits, including that the latches described herein can facilitate correct installation by a user of the supply or recovery tanks within their respective tank receivers. The retaining of the latch within its corresponding catch can provide tactile feedback for a user that a tank has been properly installed. For example, by pulling on or wiggling a tank with a small amount of force below the threshold for disengaging the latch, lack of movement of the tank can provide feedback for a user that the tank is properly seated and secured. In addition, the latches can provide for improved sealing of the supply and recovery tanks as the spring-biased latches are retained within their respective catches.

To the extent not already described, the different features and structures of the various embodiments of the present disclosure may be used in combination with each other as desired. For example, the features of the latch illustrated and/or described with respect to the supply and recovery tanks 18, 30 can be used on only one of the tanks 18, 30. Thus, the various features of the different embodiments may be mixed and matched as desired to form new embodiments, whether or not the new embodiments are expressly described.

While aspects of the present disclosure have been specifically described in connection with certain specific embodiments thereof, it is to be understood that this is by way of illustration and not of limitation. Reasonable variation and modification are possible within the scope of the forgoing disclosure and drawings without departing from the spirit of the present disclosure which is defined in the appended claims.

What is claimed is:

1. A surface cleaning apparatus, comprising:
a housing comprising a base, a partition extending upwardly from the base, and a carry handle;
a fluid delivery system comprising a supply tank;
a fluid recovery system comprising a recovery tank, an extraction nozzle, and a motor/fan assembly;
a first void within the housing, the first void defined by the base, the partition, and the carry handle, wherein the supply tank is removably received in the first void;
a second void within the housing, the second void defined by the base, the partition, and the carry handle, wherein the recovery tank is removably received in the second void; and
a spring-biased tank latch disposed on at least one of the partition and the carry handle, the tank latch comprising one of:
a supply tank latch to secure the supply tank in the first void; and
a recovery tank latch to secure the recovery tank in the second void.

2. The surface cleaning apparatus of claim 1, wherein the partition comprises:
a first overhanging portion spaced above the base on a first side of the partition; and
a second overhanging portion spaced above the base on a second side of the partition;
wherein the tank latch is provided on an underside of one of the first overhanging portion and the second overhanging portion.

3. The surface cleaning apparatus of claim 2, wherein the partition comprises the carry handle at an upper portion thereof and wherein the first and second overhanging portions are disposed below the carry handle.

4. The surface cleaning apparatus of claim 1, wherein at least one of the partition and the carry handle comprises a pocket in which the tank latch is mounted.

5. The surface cleaning apparatus of claim 4, wherein:
the tank latch comprises a latch member mounted in the pocket for movement between a retracted position and an extended position where the latch member extends from the pocket.

6. The surface cleaning apparatus of claim 1 comprising a catch provided at an upper portion of one of the supply tank and the recovery tank, the catch configured to retain the tank latch.

7. The surface cleaning apparatus of claim 6, wherein the one of the supply tank and the recovery tank comprises a blow-molded tank body and the catch is integrally formed with the blow-molded tank body.

8. The surface cleaning apparatus of claim 1 wherein the partition comprises the carry handle at an upper portion thereof.

9. A surface cleaning apparatus, comprising:
a housing comprising a base and a partition extending upwardly from the base and defining a partition plane;
a supply tank removably mounted on the housing on a first side of the partition plane;
a recovery tank removably mounted on the housing on a second side of the partition plane;
a supply tank latch to secure the supply tank to the housing, the supply tank latch moveable along a first latch axis that intersects the partition plane; and
a recovery tank latch to secure the recovery tank to the housing, the recovery tank latch moveable along a second latch axis that intersects the partition plane and the first latch axis.

10. The surface cleaning apparatus of claim 9, wherein:
the supply tank is configured to be removed from the housing by pulling the supply tank away from the partition in a first direction; and
the recovery tank is configured to be removed from the housing by pulling the recovery tank away from the partition in a second direction.

11. The surface cleaning apparatus of claim 10, wherein the second direction is directly opposite the first direction.

12. The surface cleaning apparatus of claim 9, wherein:
the supply tank latch is configured to release the supply tank upon application of a threshold pulling force on the supply tank in a direction away from the first side of the partition plane; and
the recovery tank latch is configured to release the recovery tank upon application of a threshold pulling force on the recovery tank in a direction away from the second side of the partition plane.

13. The surface cleaning apparatus of claim 9, wherein the supply tank comprises an upper end angled toward the first side of the partition plane and the recovery tank comprises an upper end angled toward the second side of the partition plane.

14. The surface cleaning apparatus of claim 13, wherein:
the supply tank comprises a first catch at the upper end angled toward the first side of the partition plane, the first catch configured to retain the supply tank latch to releasably hold the supply tank on the housing; and
the recovery tank comprises a second catch at the upper end angled toward the second side of the partition plane, the second catch configured to retain the recovery tank latch to releasably hold the recovery tank on the housing.

15. The surface cleaning apparatus of claim 9, wherein the partition comprises:
a first overhanging portion spaced above the base on the first side of the partition plane, wherein the supply tank latch is provided on an underside of the first overhanging portion; and
a second overhanging portion spaced above the base on the second side of the partition plane, wherein the recovery tank latch is provided on an underside of the second overhanging portion.

16. The surface cleaning apparatus of claim 15, wherein:
the supply tank latch comprises a first latch member mounted in the first overhanging portion for movement between a retracted position and an extended position where the first latch member extends outwardly from the first overhanging portion along the first latch axis;
the recovery tank latch comprises a second latch member mounted in the second overhanging portion for movement between a retracted position and an extended position where the second latch member extends outwardly from the second overhanging portion along the second latch axis.

17. The surface cleaning apparatus of claim 15, comprising:
a first spring biasing the supply tank latch outwardly from the first overhanging portion along the first latch axis; and
a second spring biasing the recovery tank latch outwardly from the second overhanging portion along the second latch axis.

18. The surface cleaning apparatus of claim 10, wherein the partition comprises a carry handle at an upper portion thereof which facilitates carrying the surface cleaning apparatus, wherein the carry handle extends in a direction from the first side of the partition plane to the second side of the partition plane.

19. A surface cleaning apparatus, comprising:

a housing comprising a base, a partition extending upwardly from the base, and a carry handle;

a supply tank;

a supply tank receiver comprising a first void within the housing to receive the supply tank, the first void defined by the base, the partition, and the carry handle;

a recovery tank;

a recovery tank receiver comprising a second void within the housing to receive the recovery tank, the second void defined by the base, the partition, and the carry handle;

a supply tank latch to secure the supply tank in the first void, the supply tank latch comprising a moveable supply tank latch disposed on at least one of the partition and the carry handle; and a recovery tank latch to secure the recovery tank in the second void, the recovery tank latch comprising a moveable recovery tank latch disposed on at least one of the partition and the carry handle.

* * * * *